US011304466B1

(12) United States Patent
Tellish

(10) Patent No.: US 11,304,466 B1
(45) Date of Patent: Apr. 19, 2022

(54) DEVICE AND METHOD FOR SECURING OBJECTS TO APPAREL

(71) Applicant: Greg Tellish, Ledgewood, NJ (US)

(72) Inventor: Greg Tellish, Ledgewood, NJ (US)

( * ) Notice: Subject to any disclaimer, the term of this patent is extended or adjusted under 35 U.S.C. 154(b) by 15 days.

(21) Appl. No.: 17/103,212

(22) Filed: Nov. 24, 2020

(51) Int. Cl.
*A41D 27/20* (2006.01)
*A45F 5/02* (2006.01)
*A41D 31/18* (2019.01)

(52) U.S. Cl.
CPC ..... *A41D 27/20* (2013.01); *A41D 31/18* (2019.02); *A45F 5/02* (2013.01)

(58) Field of Classification Search
CPC ..... A41D 27/20; A41D 31/18; A45F 5/02
See application file for complete search history.

(56) References Cited

U.S. PATENT DOCUMENTS 1,603,044 A * 10/1926 Gise ..... A44C 5/0046 15/224
3,968,522 A * 7/1976 Riess ..... A63B 57/20 224/919
4,069,954 A * 1/1978 Rauch ..... A63B 57/207 224/901.4
4,168,544 A 9/1979 Kallman
4,637,075 A 1/1987 Ingrisano et al.
5,154,506 A * 10/1992 Leard ..... F21L 15/14 362/108
5,584,074 A 12/1996 Battle-Smith
5,752,633 A * 5/1998 Antaki ..... A45F 5/00 224/222
5,903,928 A 5/1999 Hyung-Seob
9,931,545 B1 4/2018 Cakaterra
2,019,993 A1 11/2020 Regal
2005/0040194 A1* 2/2005 Frye ..... B25H 3/00 224/219
2013/0025019 A1 1/2013 Jones
2014/0215763 A1 8/2014 White

* cited by examiner

*Primary Examiner* — Robert Sandy
(74) *Attorney, Agent, or Firm* — Thomas J. Germinario

(57) ABSTRACT

A retaining sleeve includes a strip of elastic fabric having a rectangular, square or arcuate shape. The sleeve has two lateral sides, which are sewn onto the fabric of an underlying item of apparel. The sleeve has two open ends, which have a width equal to or less than the length of the lateral sides, and through which a retained object is received. Since the length of the sleeve's lateral sides is less than the length of the retained object, the ends of the retained object protrude beyond the sleeve ends and can be readily grasped when the object is needed.

4 Claims, 3 Drawing Sheets

DEVICE AND METHOD FOR SECURING OBJECTS TO APPAREL

FIELD OF INVENTION

The present invention relates to the general field of devices and methods for attaching objects to an item of apparel, and more particularly to such devices and methods which utilize a retaining sleeve sewn into the item of apparel.

BACKGROUND OF THE INVENTION

In everyday life, people often perform functions which require them to keep certain objects ready at hand without constantly holding them. Typical examples are mouth guards, pencils, nails/screws, screw drivers, pliers, bottle openers, etc. Under these circumstances, it is very useful to have some means of temporarily securing the objects to items of apparel one is wearing. While the prior art includes various designs for clothing loops from which such objects can hang, a more secure attachment system is needed for situations in which the wearer is actively moving and in which objects draped across a fabric loop are apt to become dislodged.

SUMMARY OF THE INVENTION

The present invention is a retainer device and an associated method for temporarily securing a retained object to an apparel item. The apparel item may be a jacket, shirt, pants, hat, shoes, gloves, belt, headband or any other item worn on the human body.

The retainer comprises a retaining sleeve, which is a strip of elastic fabric having a rectangular, square or arcuate shape. The retaining has two parallel lateral sides and two open sleeve ends, and the length of the lateral sides equals or exceeds the width of the sleeve ends. The two lateral sides are sewn into the apparel item, such that the surface of the apparel item forms the backing of the retaining sleeve.

The width of the sleeve ends equals or slightly exceeds the width of the object to be retained within the sleeve. The length of the sleeve's lateral sides is less than the length of the object to be retained within the sleeve. Thus, the sleeve is configured to receive the retained object lengthwise through one of the two open sleeve ends, such that one or both of the object's ends protrude outside the sleeve ends, thereby enabling the wearer to readily grasp one of the object's ends to pull it out from the sleeve when needed. The object is tightly secured widthwise within the sleeve by the tension of the widthwise stretching of the elastic fabric forming the sleeve.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
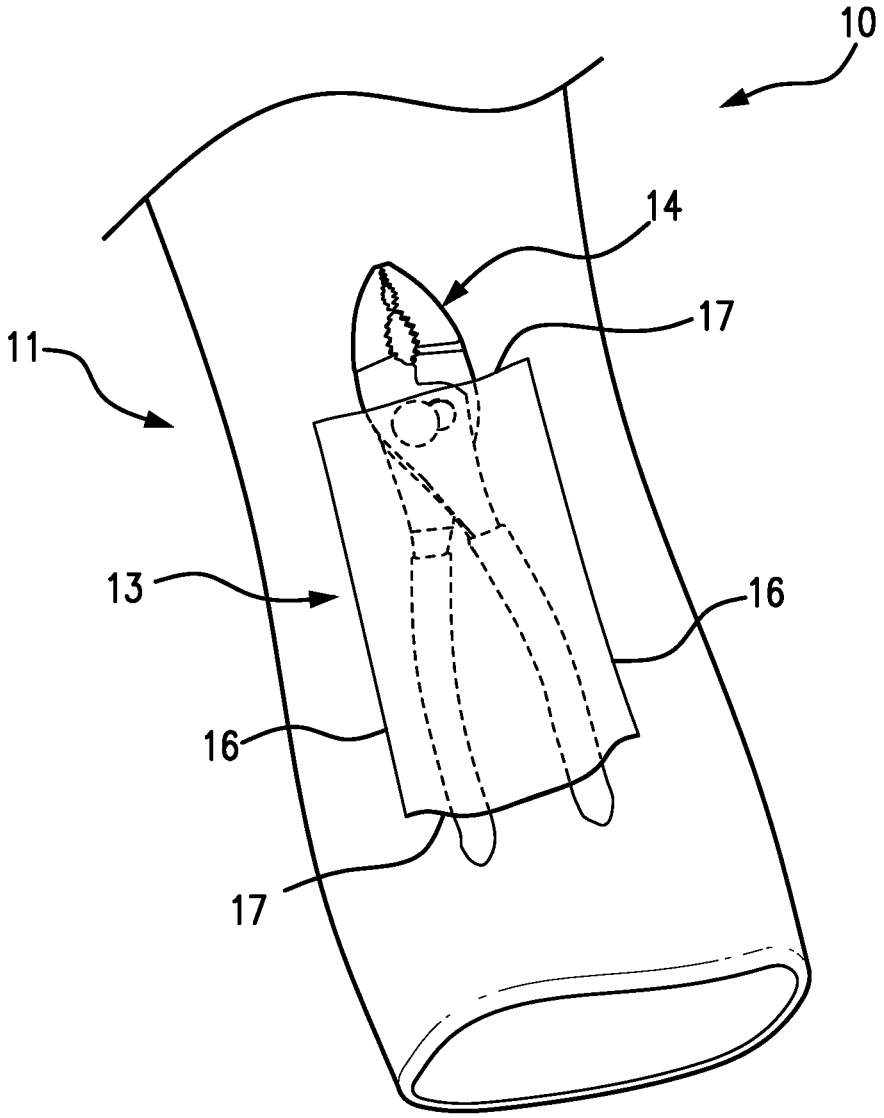
FIG. 1 is a partial perspective view of a shirt sleeve, unto which is sewn the first embodiment of the present invention, and within which is retained a pair of pliers.
Figure 2:
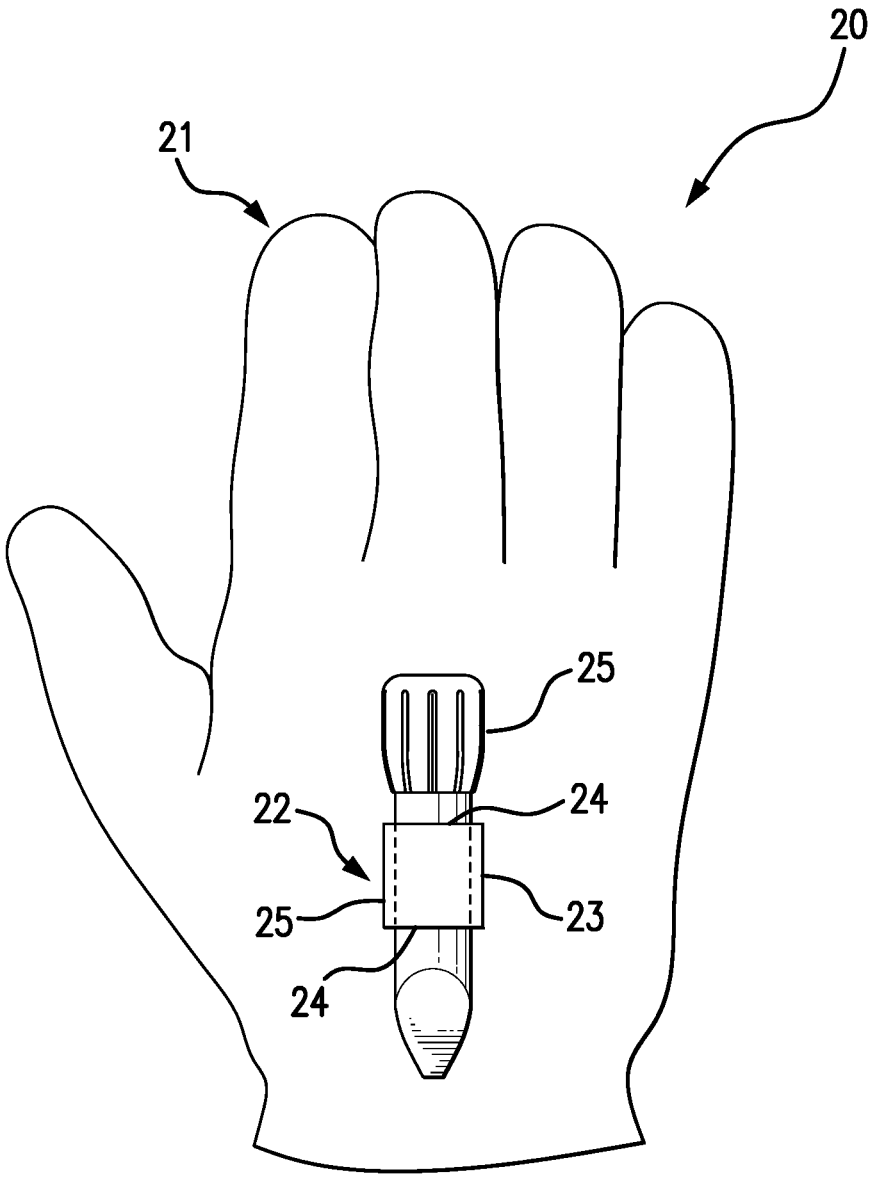
FIG. 2 is a plan view of the back of a glove, onto which is sewn the second embodiment of the present invention, and within which is retained a screwdriver.

Referring to FIG. 1, the first exemplary embodiment of the present invention 10 is depicted, as applied to a shirt sleeve 11. The rectangular retaining sleeve 13 is shown securing a pair of pliers 14. Referring to FIG. 2, the second exemplary embodiment 20 is shown, as applied to the back of a glove 21. The square retaining sleeve 22 is shown securing a small screwdriver 25. In both embodiments 10 20, the two lateral sides 16 23 of the retaining sleeve 13 22 are sewn to the underlying apparel surfaces 11 21, while the retained objects 14 25 are received through the two open sleeve ends 17 24.

Since the length of the lateral sides 16 23 is less than the length of the retained objects 14 25, the ends of the retained object 14 25 protrude beyond the sleeve ends 17 24 and can be readily grasped when the retained object 14 25 is needed.

Figure 3:
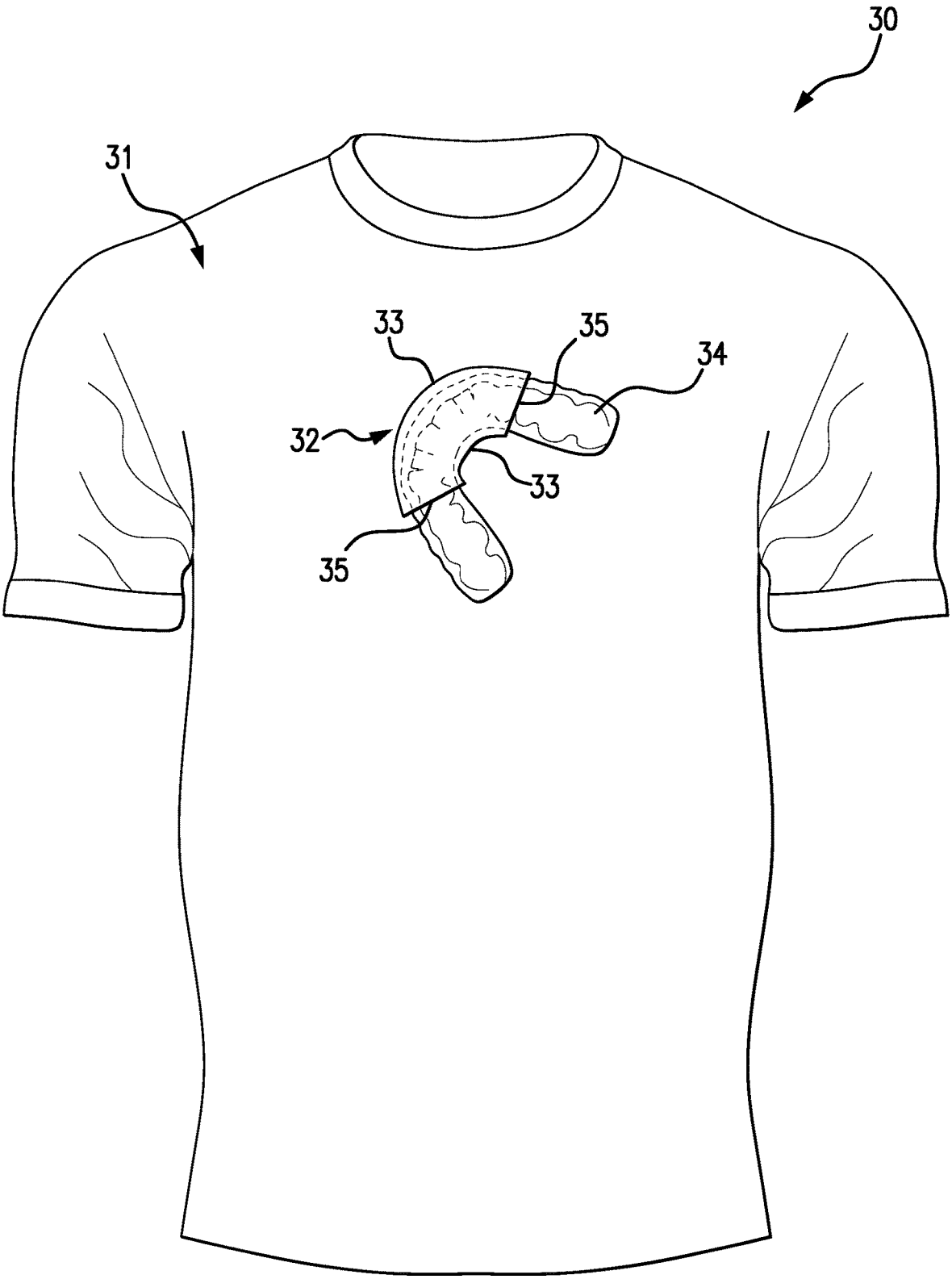
FIG. 3 is a front profile view of a tee shirt, onto which is sewn the third embodiment of the present invention, and within which is retained a mouthguard.

Referring to FIG. 3, the third exemplary embodiment of the present invention 30 is depicted, as applied to the front of a tee shirt 31. The arcuate retaining sleeve 32 is shown securing a mouthguard 34. The two lateral sides 33 of the retaining sleeve 32 are sewn to the underlying tee shirt 31, while the mouthguard 34 is received through the two open sleeve ends 35.

Since the length of the lateral sides 33 is less than the length of the mouthguard 34, the ends of the mouthguard 34 protrude beyond the sleeve ends 35 and can be readily grasped when the mouthguard is needed.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A retainer for temporarily securing a retained object, having two object ends and having an object length and an object width, to a garment, the retainer comprising:

a retaining sleeve, comprising a strip of elastic fabric having a rectangular, square or arcuate shape, and having two parallel lateral sides and two open sleeve ends, wherein the lateral sides are sewn onto an outer surface of the garment, such that the outer surface of the garment forms a backing of the retaining sleeve, and wherein a lateral length of the lateral sides equals or exceeds an end width of the open sleeve ends;

wherein the end width equals the object width, and the lateral length is less than the object length; and wherein the retaining sleeve is configured to receive the retained object lengthwise through one of the two open sleeve ends, such that one or both the object ends protrude outside the open sleeve ends, so as to constitute at least one exposed object end and such that the retained object is removably secured widthwise by stretching the elastic fabric of the retaining sleeve to achieve a widthwise retaining tension in the elastic fabric, and wherein the widthwise retaining tension in the elastic fabric permits the retained object to be grasped by the exposed object end and quickly withdrawn from the retaining sleeve.

2. A method for temporarily securing the retained object to the garment, using the retainer according to claim 1, the method comprising the following steps:

(a) inserting the retained object lengthwise into the retaining sleeve through one of the two open sleeve ends;

(b) stretching the elastic fabric of the retaining sleeve widthwise to achieve the widthwise retaining tension in the elastic fabric so as to removably secure the retained object within the retaining sleeve;

(c) leaving at least one of the object ends protruding from the open sleeve ends, so as to constitute the exposed object end;

(d) quickly removing the retained object, when needed, from the retaining sleeve by grasping the exposed object end and pulling the retained object out from the retaining sleeve; and (e) replacing the retained object, when no longer needed, within the retaining sleeve by repeating steps (a)-(c).

3. The retainer according to claim 1, wherein the elastic fabric has an arcuate shape.

4. The method according to claim 2, wherein the elastic fabric has an arcuate shape.

* * * * *